US011647828B2

(12) United States Patent
Lachapelle et al.

(10) Patent No.: US 11,647,828 B2
(45) Date of Patent: May 16, 2023

(54) TRANSFORMABLE CHAIR AND BACKPACK ASSEMBLY AND METHOD OF USE

(71) Applicants: Scott N. Lachapelle, West Palm Beach, FL (US); William S. Sherman, West Palm Beach, FL (US)

(72) Inventors: Scott N. Lachapelle, West Palm Beach, FL (US); William S. Sherman, West Palm Beach, FL (US)

( * ) Notice: Subject to any disclaimer, the term of this patent is extended or adjusted under 35 U.S.C. 154(b) by 0 days.

(21) Appl. No.: 17/494,164

(22) Filed: Oct. 5, 2021

(65) Prior Publication Data

US 2022/0104605 A1 Apr. 7, 2022

Related U.S. Application Data

(60) Provisional application No. 63/087,667, filed on Oct. 5, 2020.

(51) Int. Cl.
*A45F 4/02* (2006.01)
*A47C 13/00* (2006.01)

(52) U.S. Cl.
CPC ..... *A45F 4/02* (2013.01); *A47C 13/00* (2013.01); *A45F 2004/026* (2013.01)

(58) Field of Classification Search
CPC ..... A45F 4/02; A45F 2004/026; A47C 13/00
See application file for complete search history.

(56) References Cited

U.S. PATENT DOCUMENTS 4,676,548 A 6/1987 Bradbury
5,573,155 A 11/1996 Sadler
5,819,999 A 10/1998 Tennant
6,116,693 A 9/2000 Zammit
6,145,716 A * 11/2000 Caicedo ..... A45F 3/04 224/155
6,698,830 B1 * 3/2004 Gaines ..... A47C 15/004 297/382
7,617,956 B1 11/2009 Sabbah
7,644,981 B2 * 1/2010 Hensley ..... A47C 4/52 297/53
8,534,755 B2 * 9/2013 Nickerson ..... A47C 7/0213 297/219.1
9,591,924 B1 * 3/2017 O'Neal ..... A47C 7/664
9,949,557 B2 * 4/2018 Grimaldi ..... A45F 3/08
2003/0106915 A1 6/2003 Jo
2012/0067930 A1 3/2012 Talavera Tolentino
2019/0104829 A1 4/2019 Clary

OTHER PUBLICATIONS

"International Search Report and Written Opinion PCT/US2021/053514".

* cited by examiner

*Primary Examiner* — Brian D Nash
(74) *Attorney, Agent, or Firm* — Law Office of Mark Brown, LLC; Christopher M DeBacker

(57) ABSTRACT

A transformable floor chair has a seat and a back. The seat has straps for carrying the chair when transformed into a transportation configuration. The straps are located on the underside of the seat when in a deployed configuration. A backpack including zippered enclosure is affixed to the rear of the floor chair back. The backpack remains usable and functional when in either the transportation configuration or the deployed configuration. When transformed into the transportation configuration, the upper portion of the seat is secured to the front face of the chair back, thereby sandwiching the chair between the straps and the backpack.

4 Claims, 11 Drawing Sheets

TRANSFORMABLE CHAIR AND BACKPACK ASSEMBLY AND METHOD OF USE

CROSS-REFERENCE TO RELATED APPLICATION

This application claims priority in U.S. Provisional Patent Application No. 63/087,667 Filed Oct. 5, 2020, which is incorporated herein by reference.

BACKGROUND OF THE INVENTION

1. Field of the Invention

The present invention relates generally to a transportable seat and method for use thereof, and more specifically to transformable chair and backpack assembly.

2. Description of the Related Art

Existing floor chairs, especially transportable and transformable floor chairs, are cumbersome and limited in functionality. While existing beach chairs and the like may include straps for carrying and pouches for storage, they are bulky, contain difficult to deploy legs, and lack comfort and secure storage that would be desirable.

Heretofore there has not been available a system or method for a transformable chair and backpack assembly with the advantages and features of the present invention.

BRIEF SUMMARY OF THE INVENTION

The present invention generally provides a transformable floor chair which has a seat and a back. The seat has straps for carrying the chair when transformed into a transportation configuration. The straps are located on the underside of the seat when in a deployed configuration. A backpack including zippered enclosure is affixed to the rear of the floor chair back. The backpack remains usable and functional when in either the transportation configuration or the deployed configuration. When transformed into the transportation configuration, the upper portion of the seat is secured to the front face of the chair back, thereby sandwiching the chair between the straps and the backpack.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Transformable Backpack and Chair System 2

Figure 1:
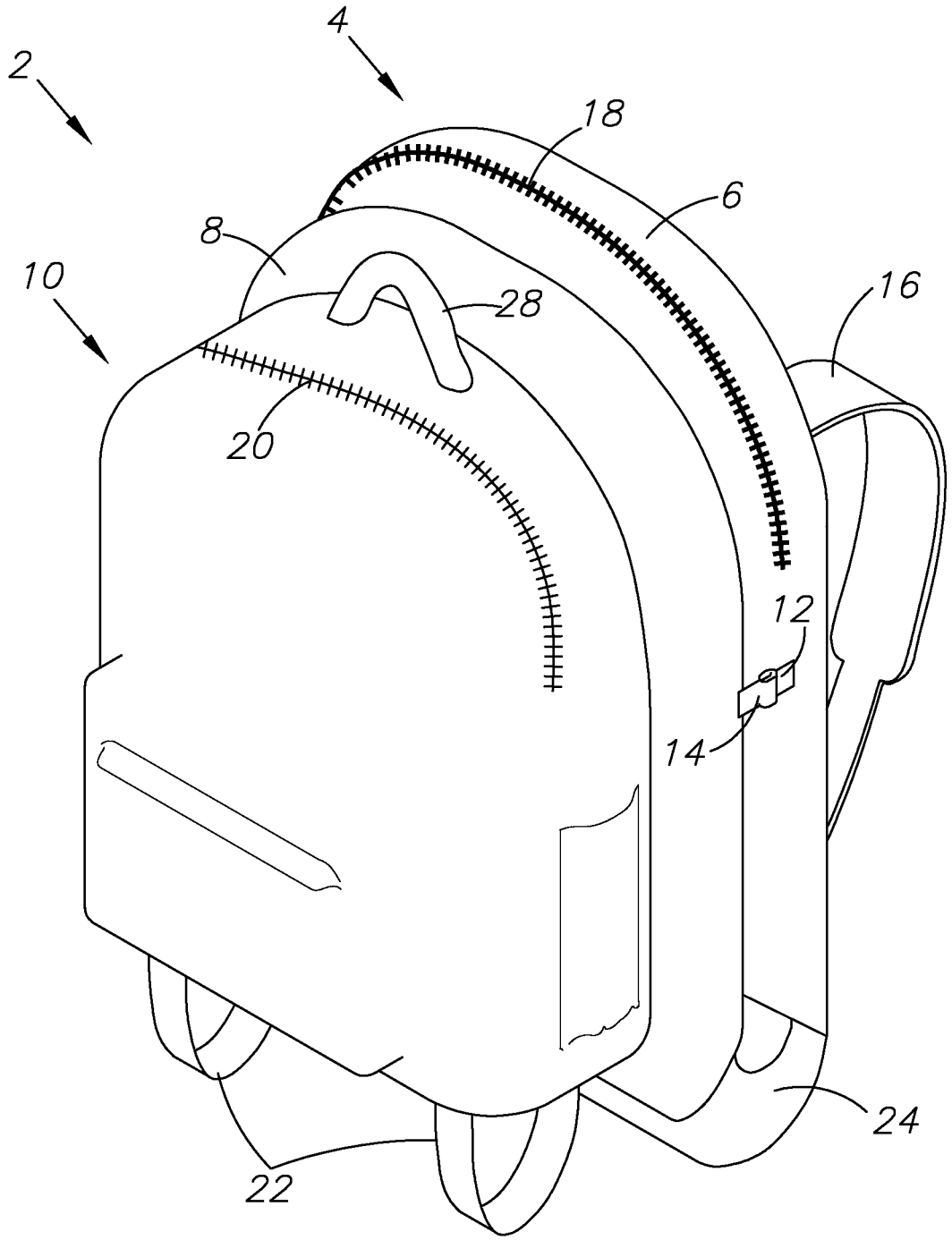
FIG. 1 is a three-dimensional isometric view of a preferred embodiment of the present invention shown from a top back view in a first, wearable orientation.
Figure 2:
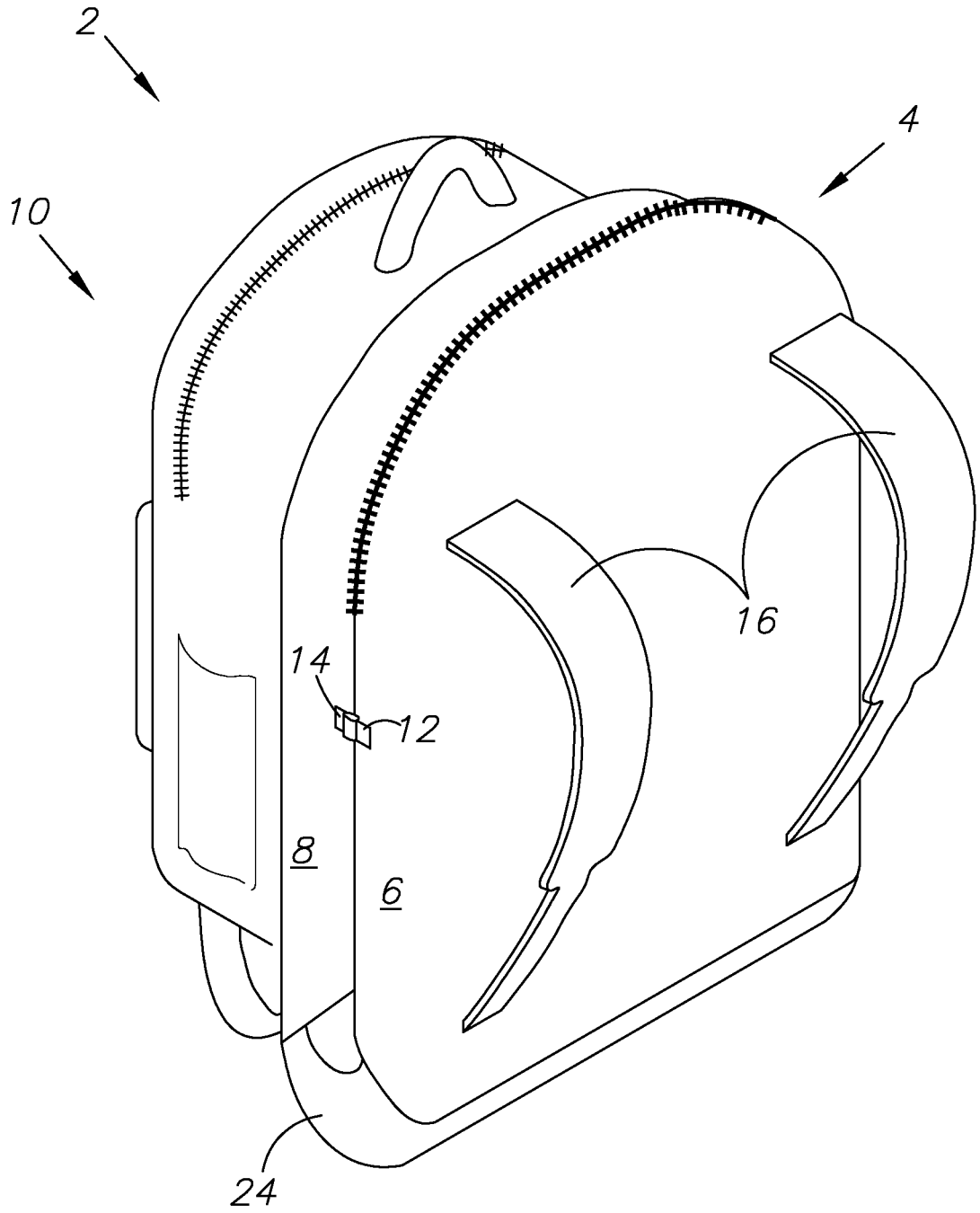
FIG. 2 is a three-dimensional isometric view thereof shown from a top front view.
Figure 3:
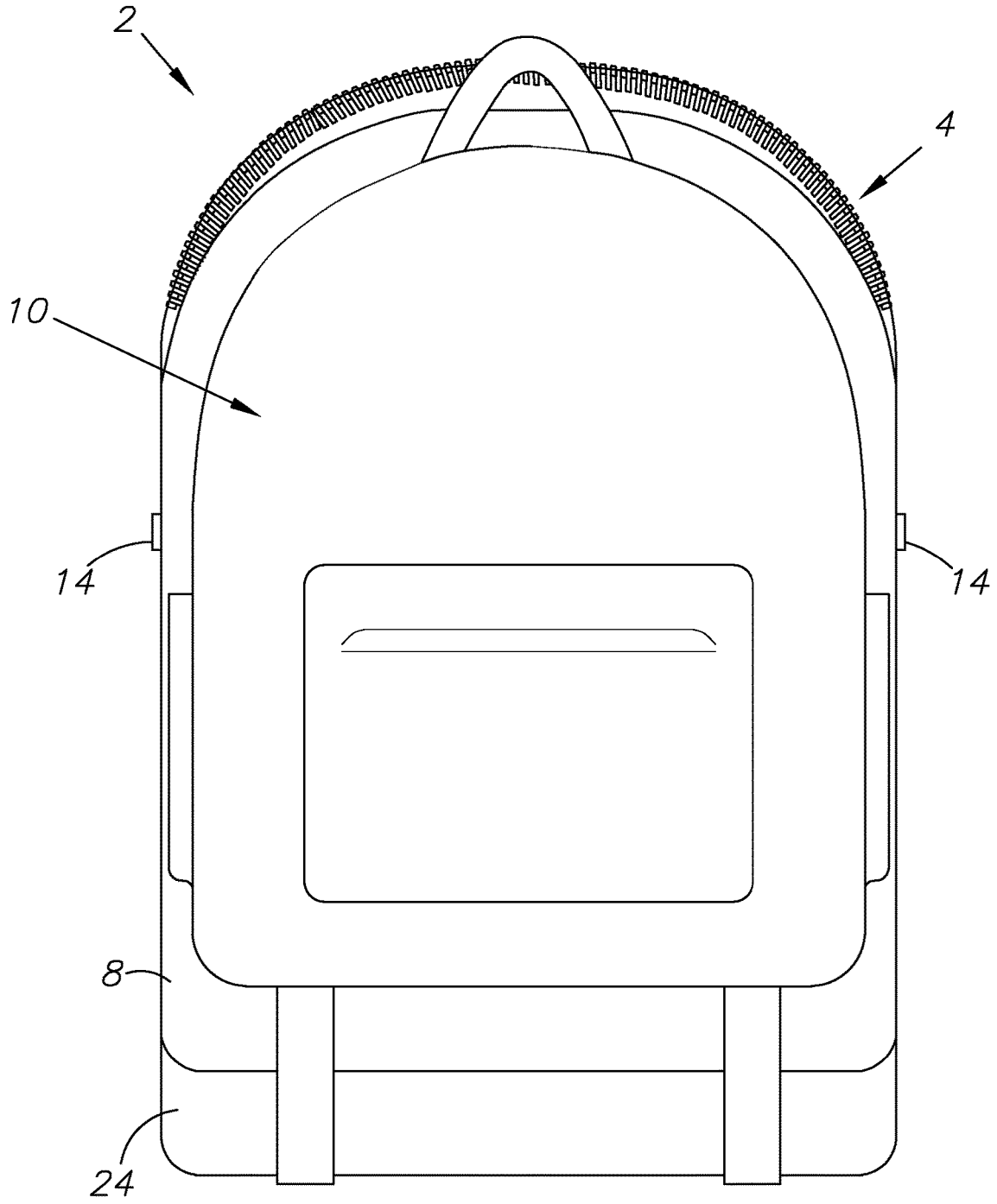
FIG. 3 is rear elevational view thereof.
Figure 4:
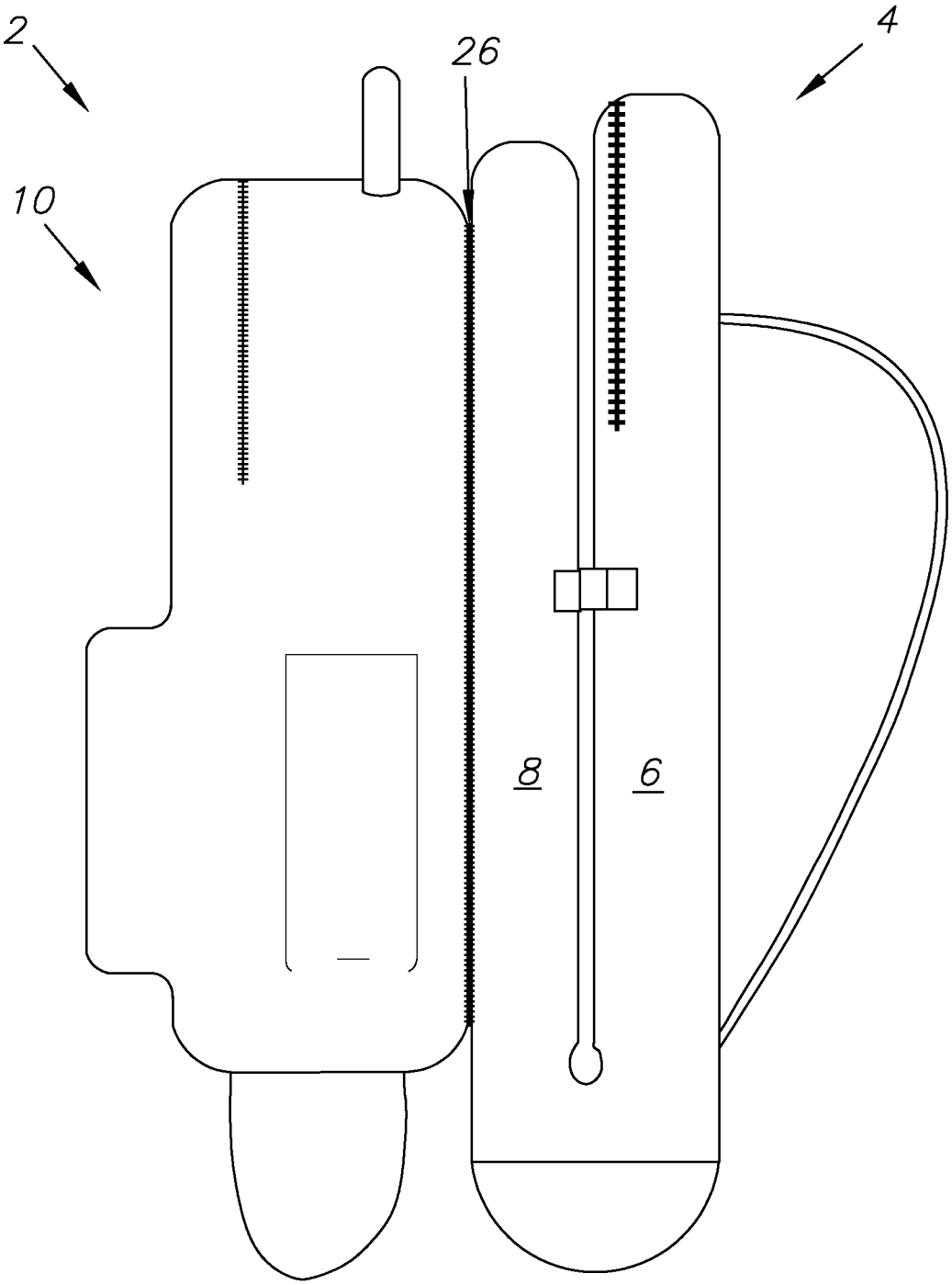
FIG. 4 is a left side elevational view thereof.
Figure 5:
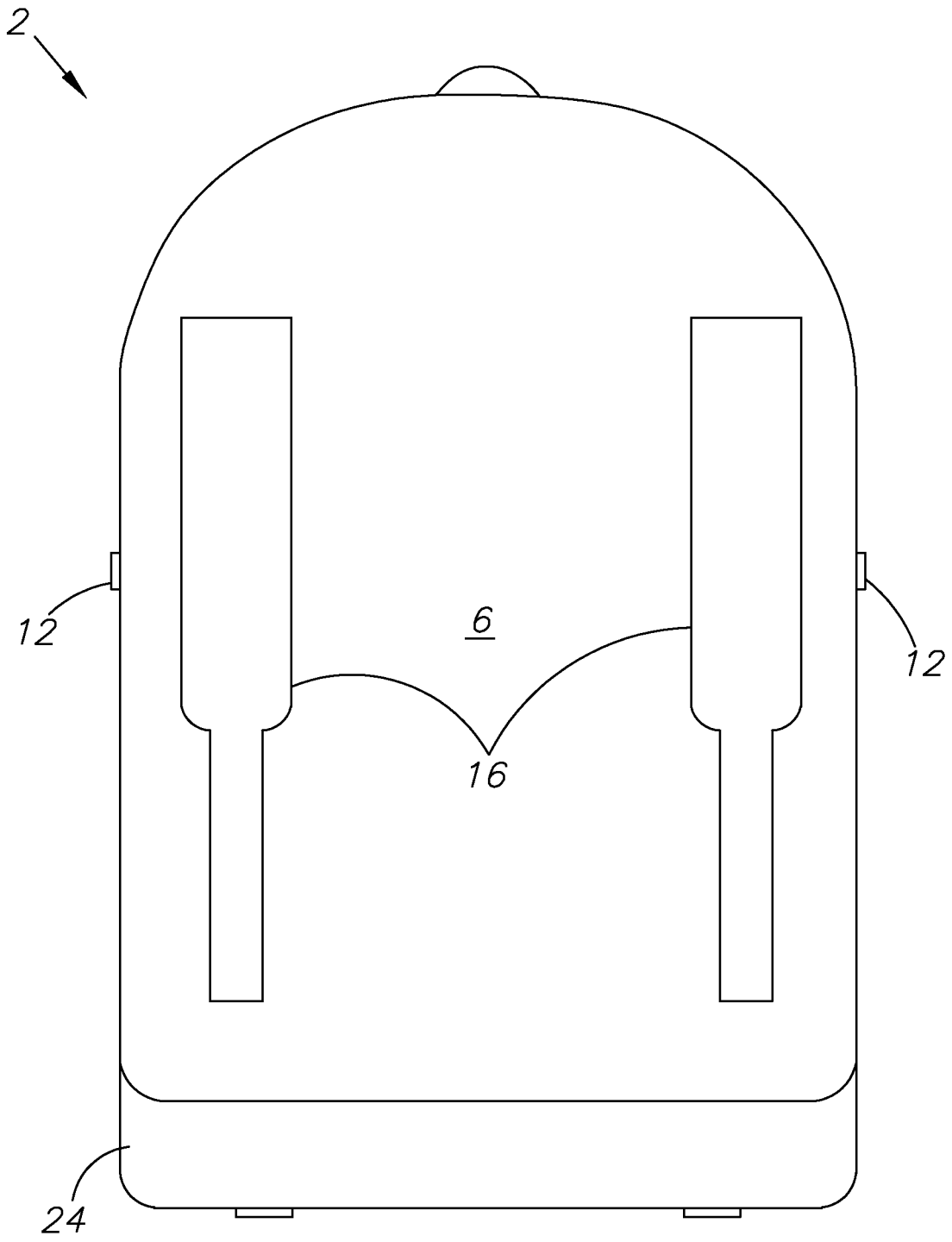
FIG. 5 is a front elevational view thereof.
Figure 6:
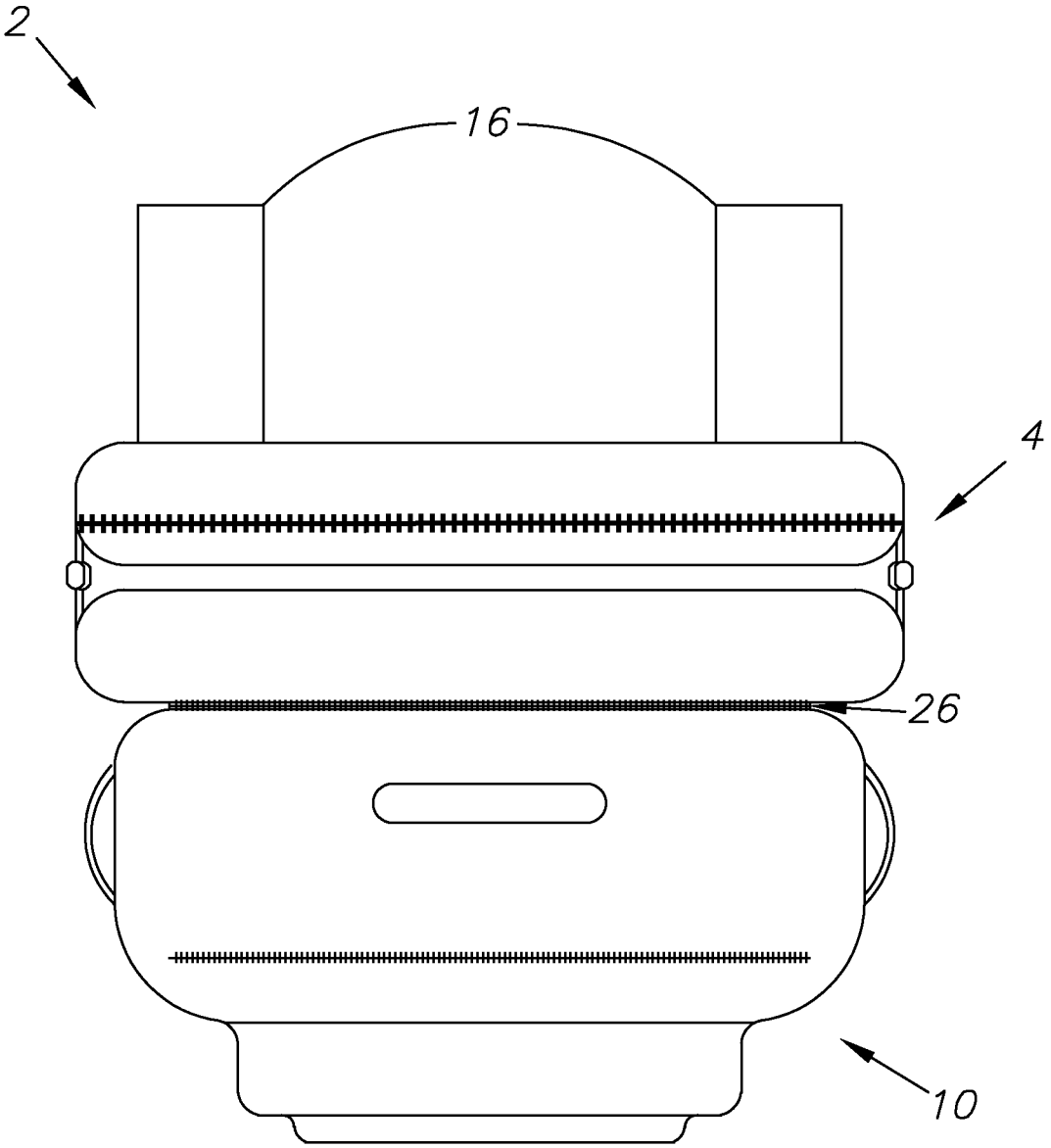
FIG. 6 is a top plan thereof.
Figure 7:
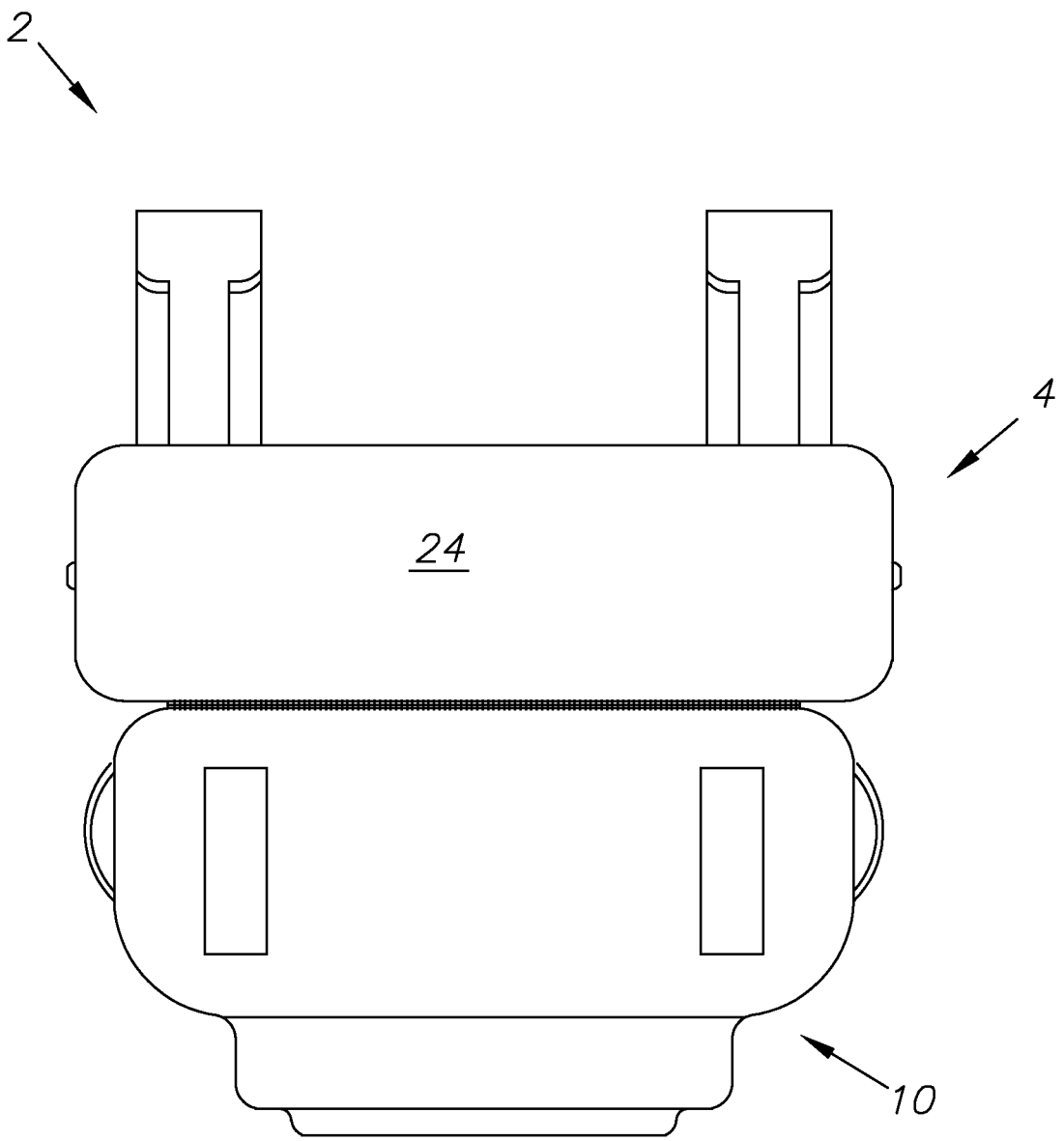
FIG. 7 is a bottom plan thereof.

As shown in FIG. 1, the present invention is a transformable backpack and chair system 2 which includes a chair portion 4 and a backpack portion 10, which may be selectively separable. The chair portion 4 includes a seat bottom 6 and a seat back 8 portion. The backpack 10 is affixed to the rear face of the seat back 8. A pair of straps 16 are affixed to the bottom face of the seat bottom 6 to function as backpack straps when the system is in a first, wearable configuration as shown in FIGS. 1-7. The backpack 10 may include a zippered opening 20 or other similar opening for storing items within the backpack.

Figure 8:
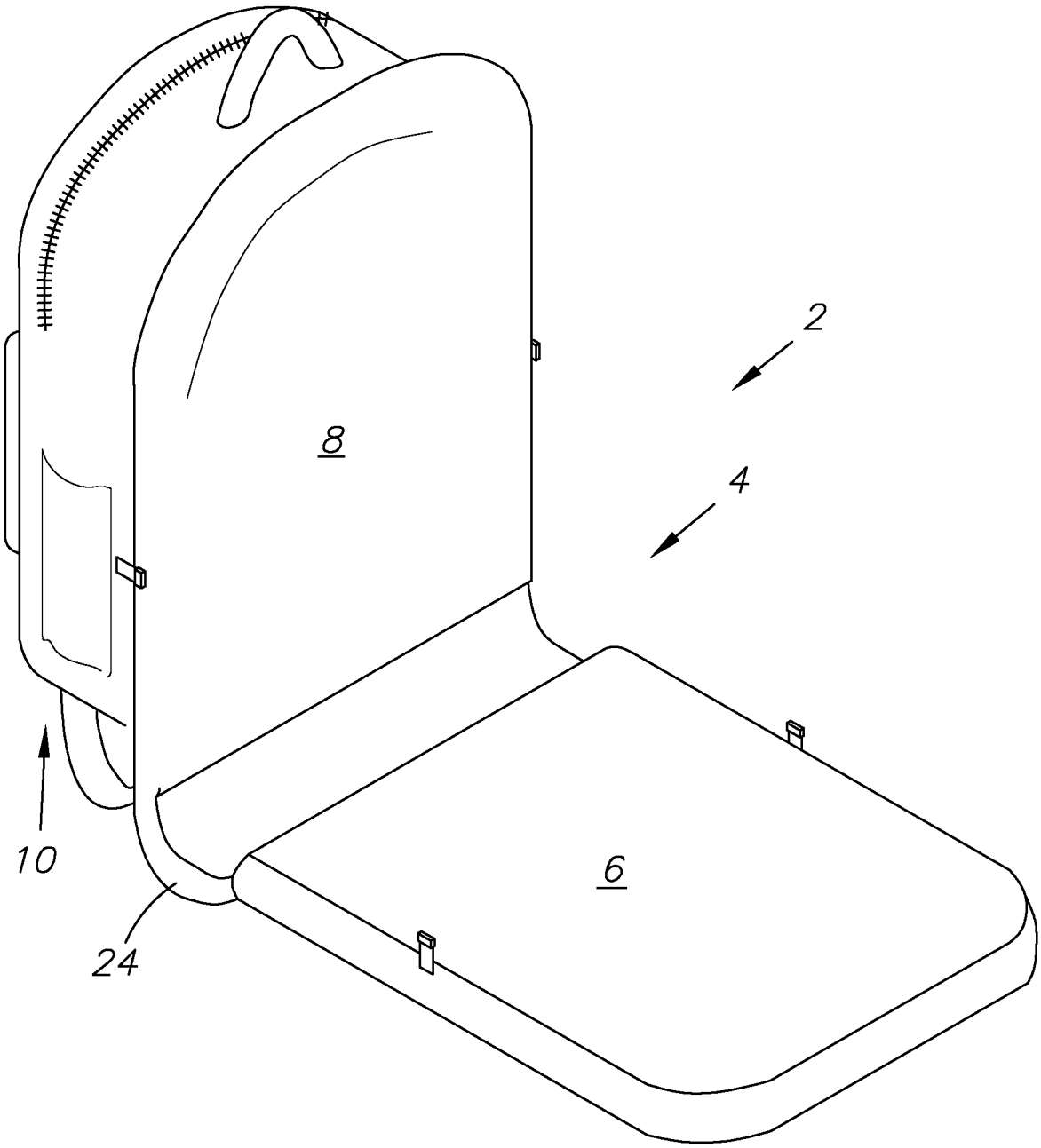
FIG. 8 is a three-dimensional isometric view of the embodiment of FIG. 2 shown in a second, deployed orientation.
Figure 9:
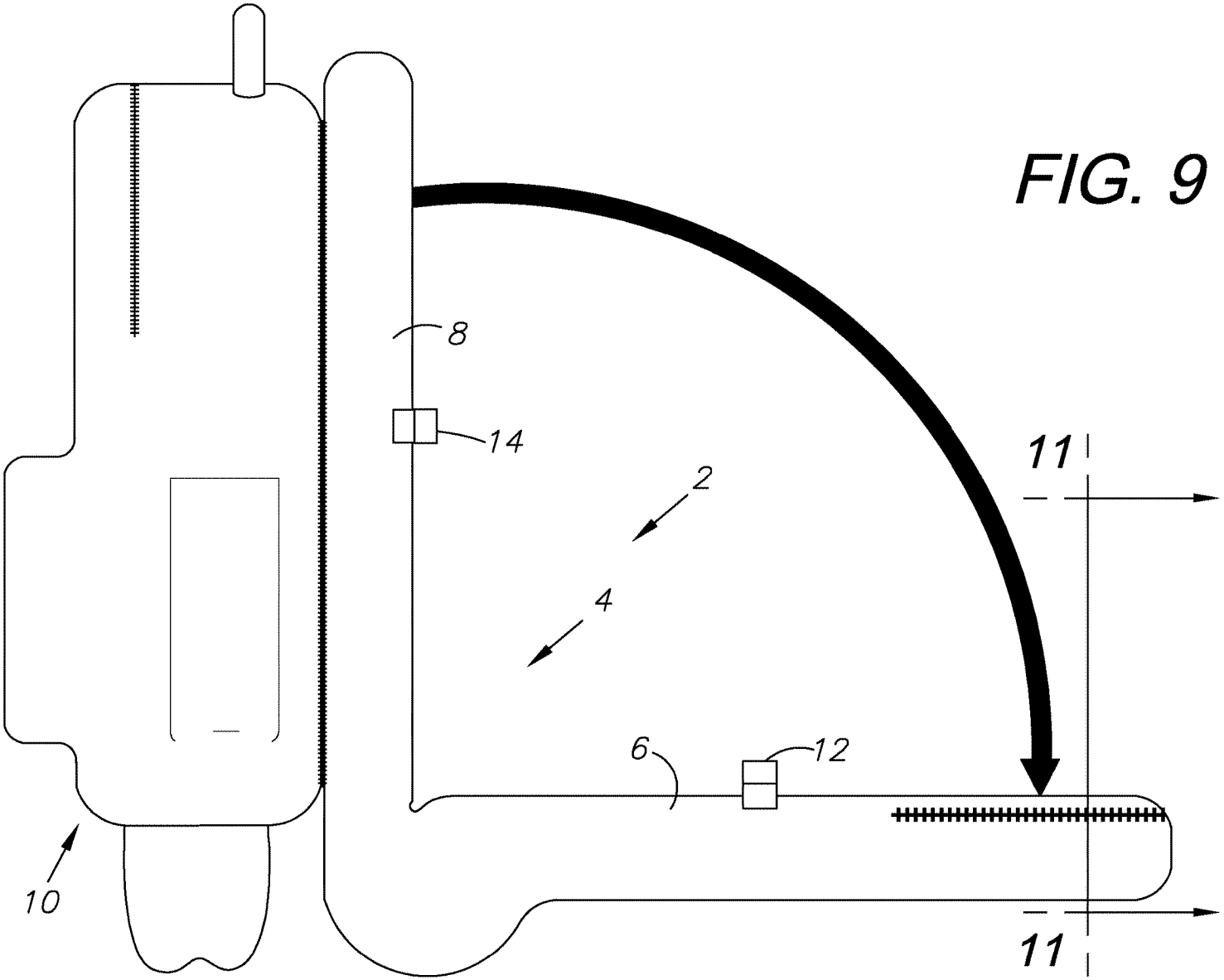
FIG. 9 is a left side elevational view thereof.

The chair is transformable between the compact, wearable configuration shown in FIGS. 1-7, and a deployed configuration shown in FIGS. 8-9, whereby the chair portion 4 is oriented to be usable by the user so that the user can sit in the seat portion 6 while resting against the seat back 8. In the wearable configuration, the top face of the seat bottom 6 is pressed against the front face of the seat back portion 8, secured via a clasp assembly, such as the clasp assembly shown having a receiving clasp 14 and an insert clasp 12, or by some other suitable securing device (e.g., a tie, a clip, a snap, hook-and-loop fasteners, etc.). This sandwiches the chair portion 4 between the straps 16 and the backpack 10, allowing the user to carry the entire assembly as if it were a backpack. The seat bottom 6 and back 8 are joined by a hinged portion 24 which allows the seat bottom 6 to flexibly move between orientations relative to the seat back 8.

When transformed into the deployed configuration as shown in FIGS. 8 and 9, the seat portion 6 is released from the clasps 12, 14 to the seat back 8 and is folded down into position, allowing a user to sit into the seat bottom 6 with their back against the seat back 8. The backpack 10 remains fully functional in either configuration.

Figure 10:
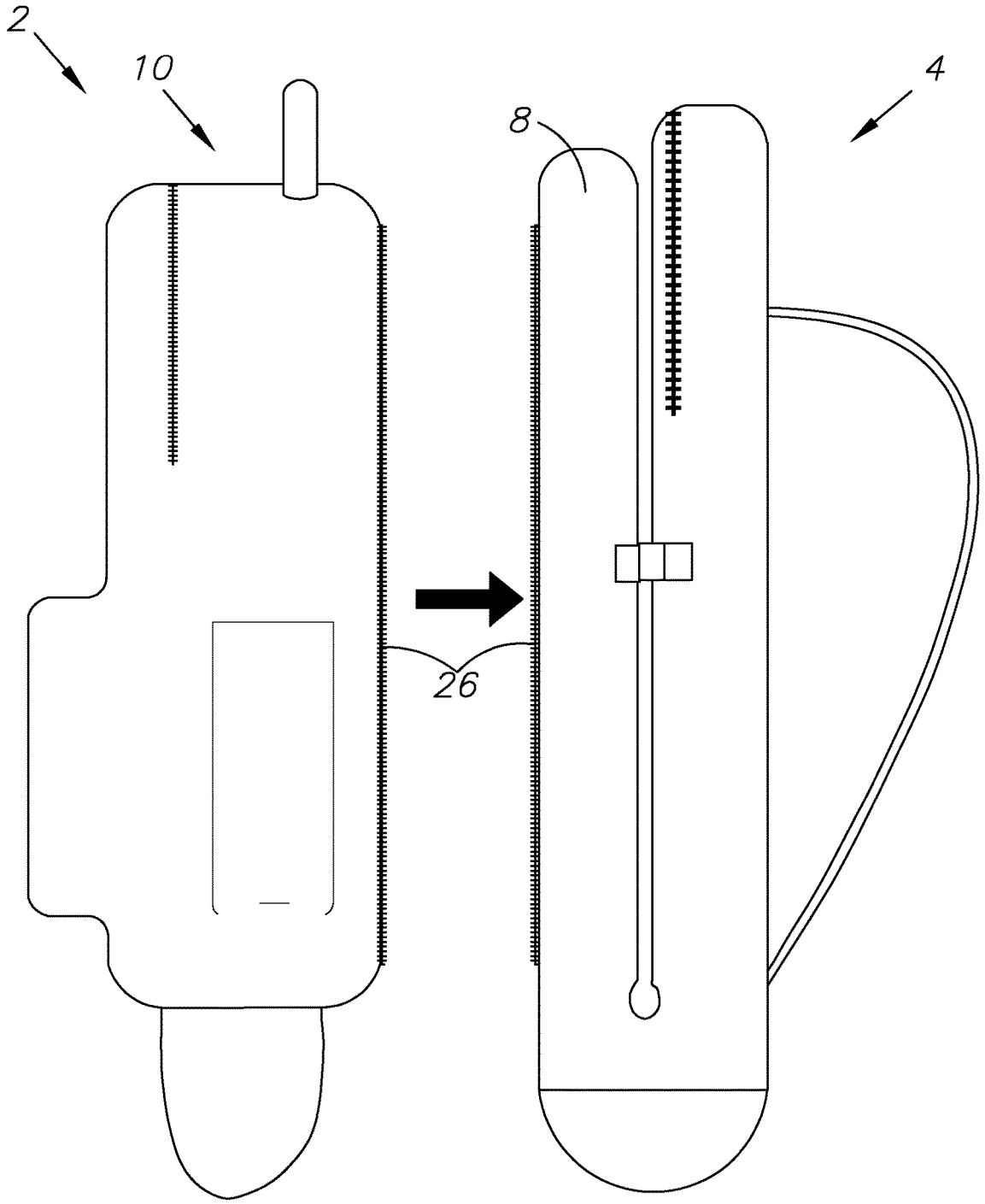
FIG. 10 is a left side elevational view of the embodiment of FIG. 1 shown in a third, separated orientation.

Loops 22 and handle 28 may optionally be included on the backpack 10 for additional utility, such as when the backpack 10 is detached from the chair 4 as shown in FIG. 10. A connector 26, such as a zippered interface, connects the front face of the backpack 10 with the rear face of the seat back 8 such that the two can be selectively separated and reconnected as desired. This allows the chair 4 and the backpack 10 to be used independently or cleaned independently.

Figure 11:
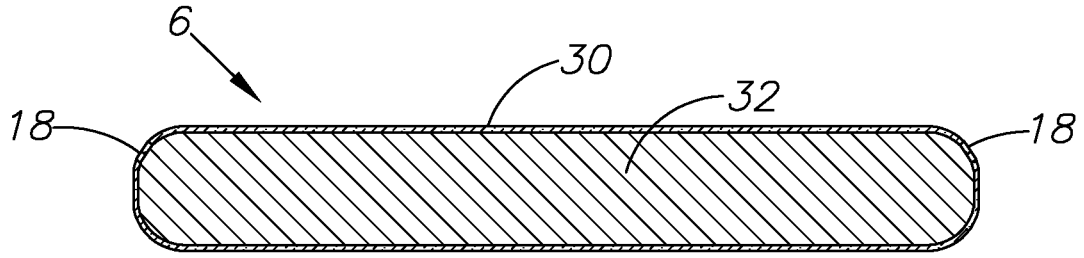
FIG. 11 is a front sectional view taken about the line of FIG. 9.

As shown in FIG. 11, the seat bottom 6, and optionally the seat back 8, can be constructed from an internal frame 32 for structural support. A foam cover 30 or otherwise cushioned pads are then placed about the frame for comfort and safety. The foam cover 30 may be secured to the internal frame 32 with a zipper 18 or by other suitable connecting means.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A combination backpack and chair system comprising:

a backpack portion and a chair portion, said chair portion having a seat bottom and a seat back;

said chair portion configured to be transformed from a first, wearable orientation whereby said seat bottom is perpendicular to said seat back and affixed to said seat back via an insert clasp affixed to said seat bottom and releasably engaged with a receiver clasp affixed to said seat back, and a second, deployed orientation whereby said seat bottom is disconnected from said seat back by removing said insert clasp from said receiver clasp and moved to an angle 90 degrees about said seat back;

a pair of shoulder straps affixed to a bottom face of said seat bottom, said pair of shoulder straps configured to allow said combination backpack and chair system to be worn when said chair portion is placed in said first, wearable orientation;

said backpack portion releasably connected to said chair portion about a connector between a front face of said backpack portion and a rear face of said seat back; and wherein said backpack portion and said chair portion are configured to be releasably separated into a third, separate orientation whereby each of said backpack portion and said chair portion are separately utilizable.

2. The system of claim 1, further comprising:

said seat bottom comprising an internal core covered by a padded covering; and said padded covering being selectively removable.

3. The system of claim 2, further comprising:

said padded covering comprising a zipper opening selectively sealable by a zipper, said zipper opening configured to allow said padded covering to be removed.

4. The system of claim 1, further comprising:

said connector comprising a zipper interface.

* * * * *